US009486681B2

(12) United States Patent
Santos Neves Júnior et al.

(10) Patent No.: US 9,486,681 B2
(45) Date of Patent: Nov. 8, 2016

(54) FLEXIBLE SURFACE AND MECHANISM FOR FORMATION OF WAVES IN THE FLEXIBLE SURFACE

(71) Applicants: Lincoln Santos Neves Júnior, Florianópolis-SC (BR); Luciana Maria Da Silva Suman Jardim, Rio de Janeiro (BR)

(72) Inventors: Lincoln Santos Neves Júnior, Florianópolis-SC (BR); Luciana Maria Da Silva Suman Jardim, Rio de Janeiro (BR)

(73) Assignee: LINCOLN SANTOS NEVES JÚNIOR, Florianópolis-SC (BR)

( * ) Notice: Subject to any disclaimer, the term of this patent is extended or adjusted under 35 U.S.C. 154(b) by 0 days.

(21) Appl. No.: 14/646,684

(22) PCT Filed: Nov. 12, 2013

(86) PCT No.: PCT/BR2013/000492
§ 371 (c)(1),
(2) Date: May 21, 2015

(87) PCT Pub. No.: WO2014/078922
PCT Pub. Date: May 30, 2014

(65) Prior Publication Data

US 2015/0314204 A1 Nov. 5, 2015

(30) Foreign Application Priority Data

Nov. 23, 2012 (BR) ..... 2012029860

(51) Int. Cl.
*A63B 69/18* (2006.01)
*A63B 69/00* (2006.01)

(Continued)

(52) U.S. Cl.
CPC ..... *A63B 69/00* (2013.01); *A63G 31/06* (2013.01); *A63B 69/0093* (2013.01)

(58) Field of Classification Search
CPC ..... A63B 69/00; A63B 69/18; A63G 31/00; A63G 31/06
USPC ..... 472/88–91, 117, 128
See application file for complete search history.

(56) References Cited

U.S. PATENT DOCUMENTS 3,964,316 A * 6/1976 Abe ..... G01M 10/00 472/128
4,148,477 A * 4/1979 Larson ..... A63B 69/18 198/580

(Continued)

FOREIGN PATENT DOCUMENTS

| | | | |
|---|---|---|---|
| BR | 8501122 | A | 11/1985 |
| BR | MU8801381 | U2 | 9/2009 |
| FR | 384083 | A | 3/1908 |
| JP | H03096662 | U | 10/1991 |
| JP | H09187574 | A | 7/1997 |
| WO | 8404695 | A1 | 12/1984 |

OTHER PUBLICATIONS

International Search Report dated Feb. 7, 2014.

(Continued)

*Primary Examiner* — Kien Nguyen
(74) *Attorney, Agent, or Firm* — Hedman & Costigan, P.C.; James V. Costigan; Kathleen A. Costigan

(57) ABSTRACT

An apparatus including a raceway comprising a flexible surface, and a mechanism located under the flexible surface that forms waves of motion in the flexible surface. The waves can be random or controlled, with varying heights. This application provides several embodiments of the mechanisms of the invention. The disclosed apparatus can be utilized for recreational, sports or industrial purposes and for other applications.

3 Claims, 4 Drawing Sheets

(51) Int. Cl.
*A63G 31/06* (2006.01)
*A63B 31/00* (2006.01)

(56) References Cited

U.S. PATENT DOCUMENTS 7,513,832 B2 * 4/2009 Gallagher ..... A63C 19/10
14/69.5
7,942,751 B2 * 5/2011 Dent ..... A63C 19/02
472/91

OTHER PUBLICATIONS

English translation of claims and description of drawings of JPH03-096862 U dated Oct. 3, 1991.
English Abstract of EP0156927(corresponds to BR8501122 A dated Nov. 5, 1985).
English Abstract of JPH09187574 A dated Jul. 22, 1997.
English Abstract of BRMU8801381 U2 dated Sep. 8, 2009.
English Description of FR384083 dated Mar. 28, 1908.

* cited by examiner

FLEXIBLE SURFACE AND MECHANISM FOR FORMATION OF WAVES IN THE FLEXIBLE SURFACE

The present application discloses an apparatus including a raceway comprising a flexible surface, and a mechanism located under this flexible surface that forms waves of motion in the flexible surface. The waves can be random or controlled, with varying heights. This application provides several embodiments of the mechanisms of the invention. The disclosed apparatus can be utilized for recreational, sports or industrial purposes and for other applications.

The current state of the art does not disclose an arrangement having a similar configuration to the mechanisms for the formation of random or controlled waves in a flexible surface that are disclosed in the present application.

The flexible surface and mechanisms for the formation of the waves in the flexible surface described herein, consist of an apparatus constituted of: a raceway comprising a flexible surface, that is made of flexible material, mounted on roller conveyor type tubes, that provide flexibility to the raceway; and a mechanism for the formation of random or controlled wave production wherein said mechanism is mounted under the raceway. The wave forming mechanism that forms the waves is mounted on tracks or guides, and the mechanism is installed under the raceway. The wave forming mechanism comprises a carriage that moves along the tracks or guides, by being pulled by a chain or gearmotor, rack and pinion or similar mechanism. The carriage has at least one set of wave-forming elements. These wave-forming elements are lever arms attached to the carriage via bearing housings with one end in contact with the lower surface of the raceway. Hydraulic or pneumatic pistons are provided that allow the elevation or depression of the lever arms for the lifting of the lever arms to elevate a corresponding section of the raceway. The displacement of the carriage produces the movement of the wave allowing the wave to move along the raceway. The elevation of the lever arm and the speed of the movement of the carriage determine the shape of the waves and the speed of movement of the waves.

The possibilities of configurations of the displacement mechanism for the carriage, as well as the arrangement of the lever arms and the mechanism for the elevation and depression of the lever arms, will be better understood from the detailed description of the invention together with the drawings and examples.

It is worth noting that the attached drawings and the following detailed description are presented merely as examples, seeing as the details of the mechanism and the specific configurations should not be interpreted as limiting, but simply as a basis for the description of the invented apparatus.

Figure 1:
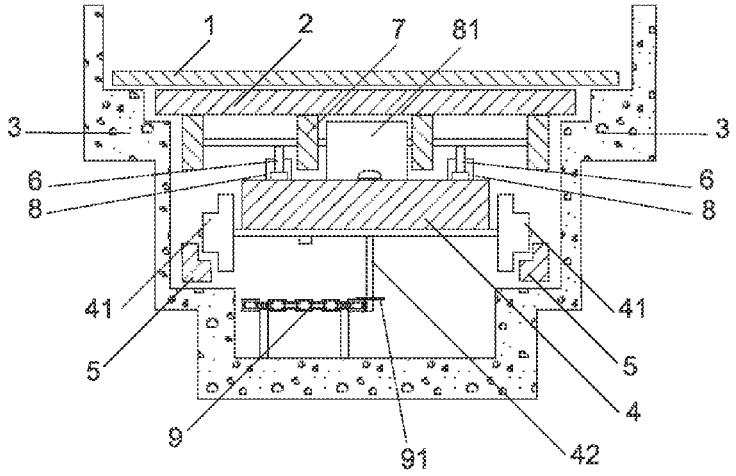
FIG. 1 shows a front view section, illustrating the configuration of the flexible surface; its raceway (1) and the mechanism for the formation of waves.

FIG. 1 illustrates the disclosed invention, comprising a raceway (1) made of flexible material, mounted on roller conveyor type tubes (2), that act as support for the raceway (1) and insures its flexibility and elevation. This raceway (1) positioned over the roller conveyor type tubes (2) should be supported by the extremities of the roller conveyor type tubes (2) in lateral supports (3), these being beams or walls or a similar structure, at a height that allows the placement of the wave-forming mechanism under the roller conveyor type tubes (2). This placement configuration of the raceway (1) and roller conveyor type tubes (2) on the wave-forming mechanism may be obtained by the use of walls and beams, or by the construction of a channel or a catwalk, as long as it supports this functional configuration. FIG. 1 discloses the placement of a carriage (4) having wheels (41) supported by tracks (5), that support the wave-forming mechanism and that will allow the movement of said mechanism along the raceway (1). The wave-forming mechanism comprises lever arms (6) attached to the carriage via bearings and at least one of the extremities of said lever arms (6) comprises rollers (7) in contact with the lower surface of the roller conveyor type tubes (2). These lever arms (6) are articulated, and they are elevated and depressed by the action of hydraulic cylinders (8), activated by hydraulic pumps (81), and fed via electrical batteries or other compatible means.

Figure 2:
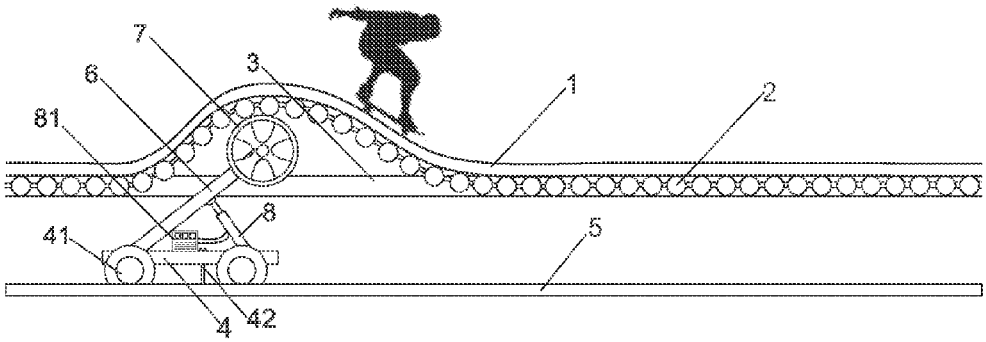
FIG. 2 shows a general representation illustrating the flexible surface and the mechanism that forms undulations positioned under the raceway.

FIG. 2 shows a side view illustration, where the lever arm (6) is presented in an elevated position, raising the roller conveyor type tubes (2) along with the raceway (1). The elevation height of the lever arms (6) may be random and depends on the configuration of the piston that is driven by the motor and hydraulic pump (81). The configuration of the piston should preferentially be controlled by automated systems, allowing the height variation of the elevation of the lever arms (6) to be random, forming different waves along the course of motion of the carriage (4). In this illustration it can be seen that as the carriage (4) moves along the tracks (5), the waves formed by the elevation of the lever arms (6) moves along the raceway (1), presenting random heights according to the configuration of the elevation and depression of the lever arms (6).

Figure 3:
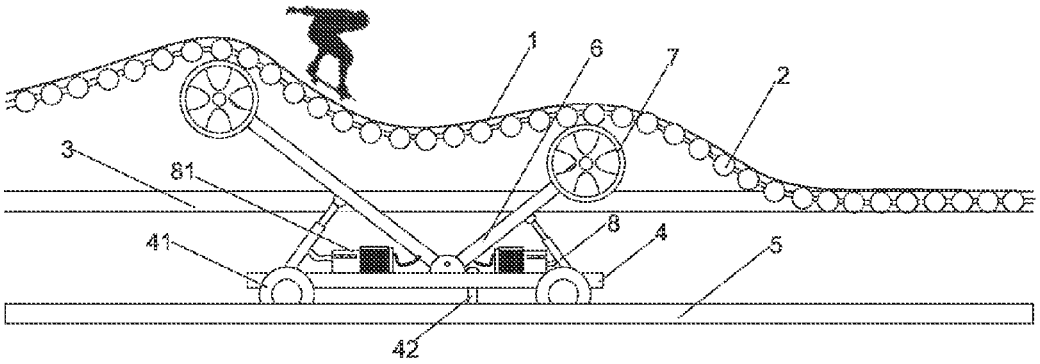
FIG. 3 shows a side view illustrating the mechanism for forming many simultaneous waves.

FIG. 3 presents an illustration showing that the lever arms (6) may exhibit a diversity of forms and configurations, as well as a plurality of lever arms (6) on the carriage (4), being activated by independent hydraulic pumps (81) and hydraulic cylinders (8). This broadens the possibilities for the different formations of waves along the raceway (1), with the movement of the carriage (4) along the tracks (5).

Figure 4:
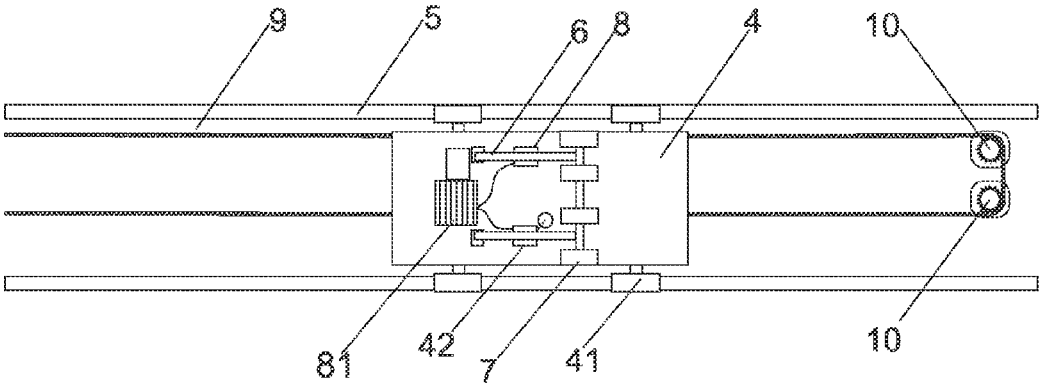
FIG. 4 shows a top view illustrating a traction mechanism for forming waves.
Figure 5:
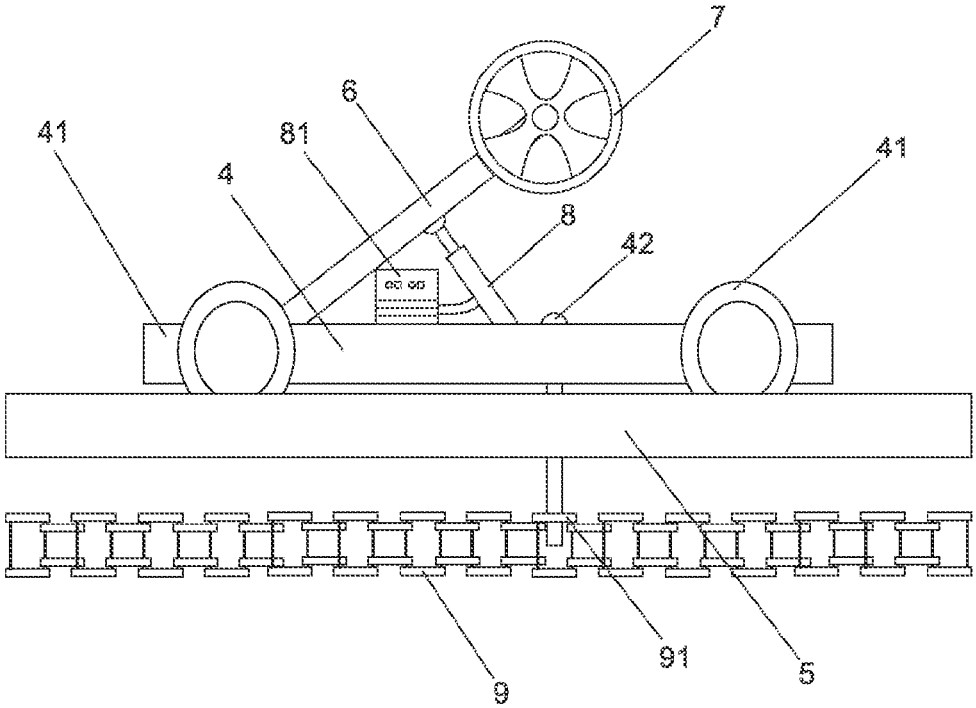
FIG. 5 shows a front view illustrating a solution for the movement of a wave-forming mechanism.
Figure 6:
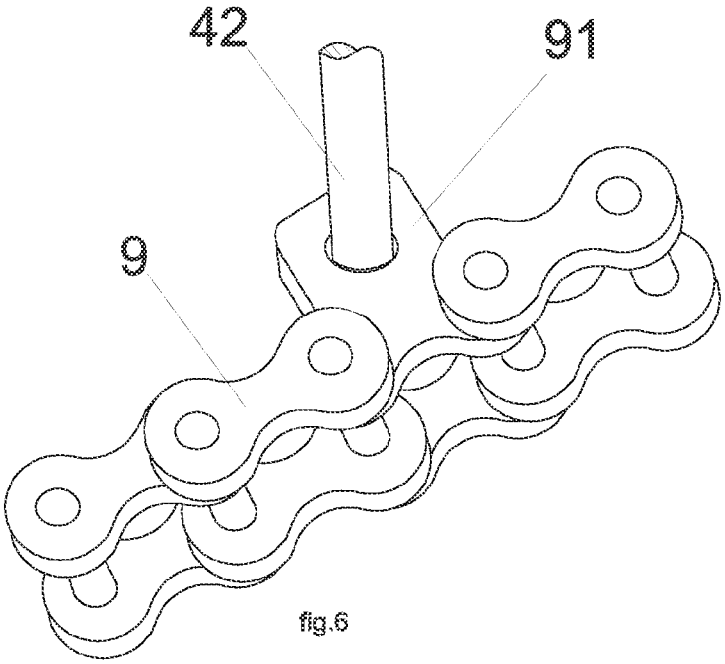
FIG. 6 shows a detail illustrating a solution for moving the wave-forming mechanism.
Figure 7:
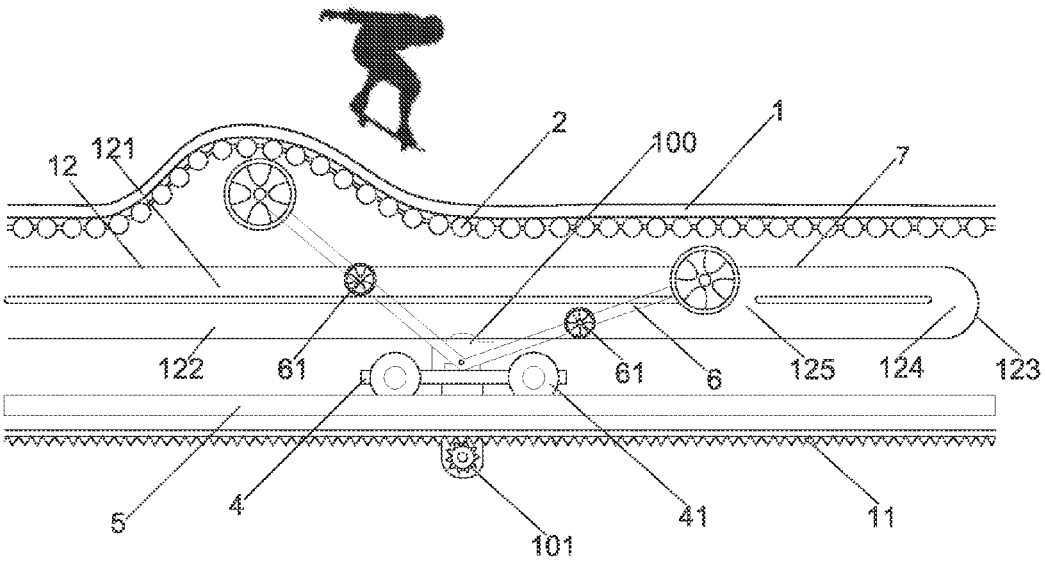
FIG. 7 shows a side view illustrating a second possible configuration for the wave-forming mechanism and the mechanism for moving the carriage (4).

The traction of the carriage (4), which moves and is a part of the wave-forming mechanism, can be achieved as illustrated in FIGS. 4 and 5, via chains (9) moved by motors (10) mounted on the structure of the track, and attached with a pin (42) coupling to the carriage (4). As shown in FIG. 5, there is a special point (91) in the chain (9) that is coupled to the carriage (4); the carriage (4) is pulled in the chain moving direction when it is pulled by the motor (10). FIG. 6 shows a detail of the configuration of the pin (42) coupled to the special point (91) of the chain (9). The movement can be continuous, following the chain (9), as long as the tracks (5) are arranged to allow for this movement. Said carriage (4) may move inside a pre-determined segment by means of a sensor that determines the end of the course, or similar device that causes the reversal of the rotation of the motors (10), causing the carriage (4) to perform a come and go motion. The traction mechanism that moves the carriage (4)

may use flexible or similar steel cables in substitution of the chain (9). FIG. 7 shows an illustration of another possible configuration for the wave-forming mechanism and the mechanism that moves the carriage (4), in tracks with pre-defined formations of waves or the carriage (4) performs a come and go motion over the tracks (5). In this configuration the moving mechanism consists of a rack (11) mounted along the tracks and a motor (100), mounted on the carriage (4); said motor (100) activates the pinion (101) that connects to the rack (11). The rotation of the motor (100) allows for the displacement of the carriage (4) along the track (5); at the end of the course of motion of the carriage (4), the rotation of the motor (100) reverses, allowing the carriage (4) to return via the tracks (5), causing the come and go motion. The wave-forming mechanism may also have another configuration, given that the wave form is pre-defined. The hydraulic cylinder (8) that elevates the lever arms (6) as well as the other components installed to activate said hydraulic cylinder (8), for example, hydraulic pumps (81), are replaced by a guide (12), containing two channels (121 and 122), and by guiding elements (61) connected to the lever arms (6). These guiding elements (61) are positioned and move along these channels (121 and 122), at a height pre-defined by the positioning of the guiding elements (61) on the lever arms (6). FIG. 7 shows the functioning of the inversion of the heights of the lever arms (6) at the end of the course of the wave track. The guide (12) provides ends (123) and rounded openings (124 and 125) between the channels (121 and 122) with spacing and dimensioning so as to allow the simultaneous passage of each guiding element (61) of each lever arm (6) between each of the openings (124 and 125), promoting the inversion of the guiding elements (61) of each of the lever arms (6) in the carriage (4). The height inversion of the elevation of the lever arms (6) allows for the come and go motion of the carriage (4) along with the pre-determined waves.

The invention claimed is:

1. An apparatus for the formation of waves for use in recreation, sports, and industry, comprising a raceway (1) having a flexible surface, carriages (4) having wheels (41) supported by tracks (5), mounted under said raceway (1), said carriages having a wave forming mechanism that forms waves in said raceway (1), said raceway being supported by roller conveyor type tubes (2) mounted in lateral supports (3); said carriages (4) with wheels (41) being supported on rails (5) installed under said carriages (4) having a wave-forming mechanism comprising at least one articulated lever arm (6) attached via a bearing race to said carriage (4), wherein at least one end of said at least one articulated lever arm (6) comprises rollers (7) in contact with the lower surface of the roller conveyor type tubes (2) wherein elevation of said at least one articulated lever arm (6) forms at least one elevation of said raceway (1), said raceway (1) being elevated by the elevation of said at least one articulated lever arm (6) as said carriage (4) moves along said tracks (5); said at least one articulated lever arm (6) being articulated by hydraulic cylinders (8) driven by hydraulic pumps (81) that elevate said at least one articulated lever arm (6) to random heights.

2. The apparatus according to claim 1, wherein the carriage (4) comprises a traction mechanism having a rack (11) mounted on tracks (5) and a motor (100) mounted on the carriage (4); and said motor having a pinion (101) that connects to said rack (11), so that the rotation of the motor (100) allows the movement of the carriage (4) along said track (5) from a starting point; wherein when said carriage (4) reaches an end of said track, the direction of rotation of said motor (100) is reversed; allowing the carriage (4) to return on the tracks (5) to said starting point to realize a back-and-forth movement.

3. An apparatus according to claim 1, wherein the wave formation mechanism comprises a guide (12) constituted of two channels (121 and 122), and having guiding elements (61) connected to the articulated lever arms (6); and said guiding elements (61) being positioned to move along said channels (121, and 122), at a height pre-determined by the positioning of the guiding elements (61) the articulated lever arms (6); and by the guide (12) having ends (123) and openings (124 and 125) between said channels (121 and 122) with size and spacing so as to allow the simultaneous passage of of the guiding elements (61) of each lever arm (6) through each of the openings (124 and 125); and for allowing reversal of the position and movement of the guiding elements (61) of each articulated lever arm (6).

* * * * *